United States Patent [19]

Popovitch

[11] Patent Number: 4,699,058

[45] Date of Patent: Oct. 13, 1987

[54] SAFING AND ARMING DEVICE AND METHOD

[75] Inventor: Dragolyoub Popovitch, Denville, N.J.

[73] Assignee: Interdyne Service Corporation, North Tarrytown, N.Y.

[21] Appl. No.: 861,273

[22] Filed: May 9, 1986

[51] Int. Cl.[4] ..... F42C 19/00

[52] U.S. Cl. ..... 102/275; 102/259

[58] Field of Search ..... 102/275, 258, 259, 424, 102/231-240, 242, 245, 247-250, 253, 255

[56] References Cited

U.S. PATENT DOCUMENTS

| | | | |
|---|---|---|---|
| 1,702,133 | 2/1929 | Rémondy | 102/275 |
| 1,706,802 | 3/1929 | Methlin | 102/275 |
| 1,806,877 | 5/1931 | Hole | 102/235 |
| 1,956,222 | 4/1934 | Methlin | 102/275 X |
| 2,651,993 | 9/1953 | Bergof et al. | 102/232 |
| 3,326,132 | 6/1967 | Tlam | 102/236 |
| 3,952,663 | 4/1976 | Forst et al. | 102/275 |
| 4,449,456 | 5/1984 | Foss et al. | 102/240 |
| 4,467,723 | 8/1984 | Kaiser et al. | 102/240 |
| 4,471,698 | 9/1984 | Rentfrow et al. | 102/234 |
| 4,619,200 | 10/1986 | Bell | 102/275 |

FOREIGN PATENT DOCUMENTS

| | | | |
|---|---|---|---|
| 83957 | 7/1935 | Sweden | 102/232 |

*Primary Examiner*—David H. Brown

*Attorney, Agent, or Firm*—William J. Ruano

[57] ABSTRACT

A mine fuze timer having a ball serving as a locking element, which ball is released after the elapse of a predetermined time period. Such time period may be determined by a timer by exerting needed load against a readily deformable material, or as an alternative, by a dash-pot using a viscous liquid. The mine fuze timer is glued to the top of a mine containing a borerider and is encased in a mine canister. A fuze for small caliber ammunition, with a barrier consisting of two halves tied together by a soft wire and locked in safe position by two setback pins. The stretching and the eventual ruture of the soft wire, under the influence of spin which follows the setback at the time of firing, ensures the necessary safety delay for arming.

9 Claims, 10 Drawing Figures

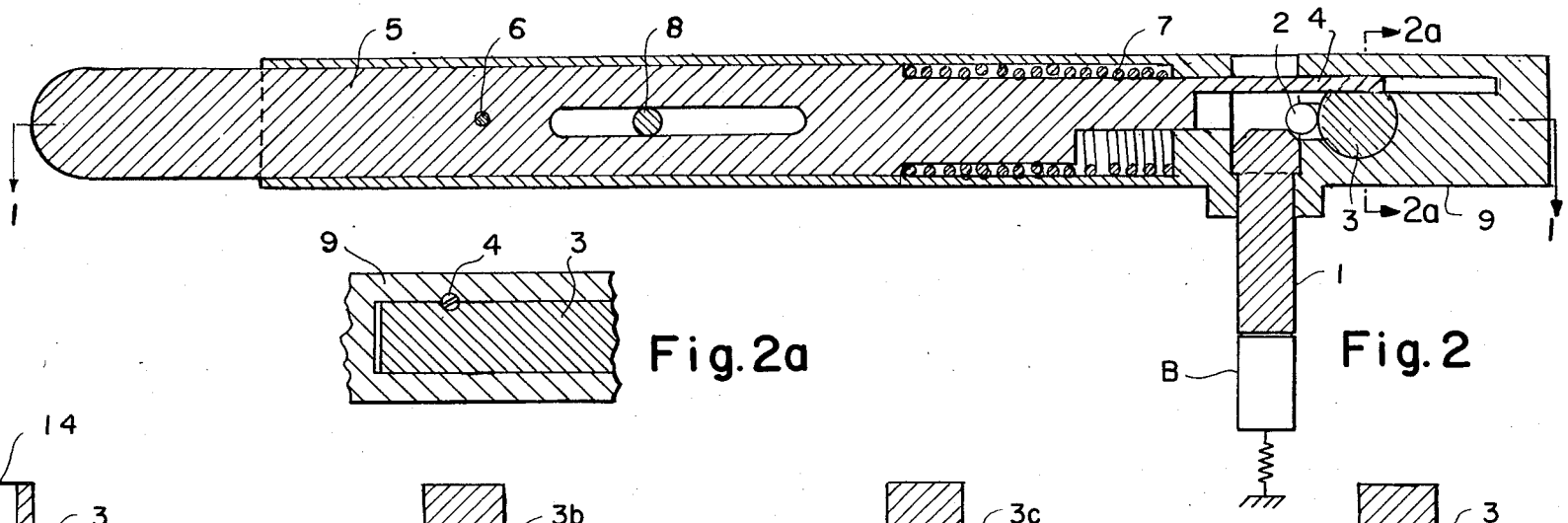
Fig.2
Fig.2a
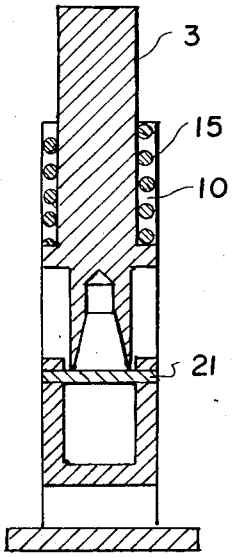
Fig.6
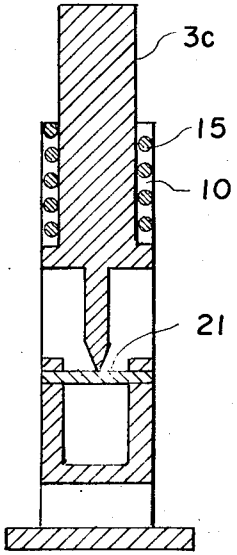
Fig.5
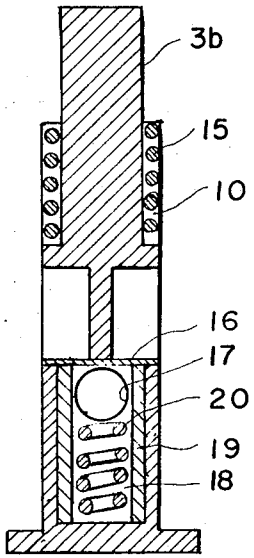
Fig.4
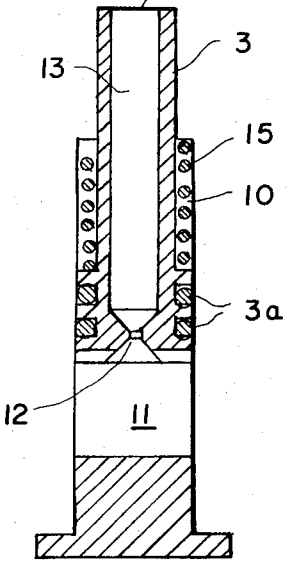
Fig.3

SAFING AND ARMING DEVICE AND METHOD

BACKGROUND OF THE INVENTION

In every kind of explosive ammunition, there is a need for a safing and arming (or S & A) mechanism, the purpose of which is twofold:

- to ensure safety in handling, transportation and storage; and
- to ensure arming after a suitable safety delay following the ejection of the ammunition from its launcher.

One of the main objectives of the present invention is to provide a new method of ensuring the aforementioned safety delay, using either viscous flow or creep as the underlying physical phenomenon.

EXAMPLE A

In a family of mines designed for massive use, the fuze is held in safe position within each mine by a part called "borerider", which, in turn, is locked in safe position by an appropriate shear pin. Thus, no accidental arming can take place during handling, transportation and storage.

For field delivery, the mines are loaded into canisters as shown in FIG. 7. At that time, as each mine is loaded, its borerider B is pressed through an opening in the mine cover, and the borerider shear pin S is broken, but safety is still ensured by the fact that the canister itself keeps the borerider in safe position. Only after the mine is ejected from the canister does it become possible for the borerider to move and for the fuze to arm. Normally, an internal time-delay element permits arming to take place only after the delivery crew has been given enough time to reach safe distance. However, that element occasionally malfunctions and allows arming to take place as soon as the mine leaves the canister. To protect the delivery personnel from that contingency, it has been decided to equip each mine with an additional arming-delay mechanism. That mechanism, hereinafter referred to as the mine fuze timer, is one example of a possible application of the proposed new concept.

EXAMPLE B

In the ammunition for a family of small caliber automatic weapons, the space available for the S & A mechanism is very limited. Due to that limitation, the most practical way to ensure the S & A function is by means of a barrier interrupting the explosive train and held in place by an element which, at the time of firing, gradually deforms and/or ruptures. Such a gradual deformation and/or rupture provides a safe arming delay, and constitutes another example of a possible application of the present invention.

SUMMARY OF THE INVENTION

Example A

The subject mechanism, glued on top of a mine, ensures safety by interlocking with the borerider within the mine via an interlocking pin 1. When the mine is loaded into a canister for delivery, the trigger 5 is pushed into the timer body 9 and its shear pin 6 is broken, but the canister keeps the trigger 5 in safe position. When the mine is ejected out of the canister, the trigger 5 moves under pressure of its spring 7 and retracts its finger 4, thus freeing the timing mechanism to start measuring the appropriate time delay.

Various solutions are proposed to ensure the timing function, but they all lead to a delayed movement of a cylindrical element 3 which, via the ball 2 and the interlocking pin 1, frees the borerider within the mine to move to the armed position.

Example B

A barrier, consisting of two halves tied together by means of a soft or stretchable wire or a soft foil strip, is interposed in a channel between the detonator and the rest of the explosive train. At rest, both halves are locked in place by means of setback pins. At the moment of firing, the setback causes both pins to unlock, whereupon the increasing spin causes the connecting wire or foil strip to gradually deform and to rupture, thereby ensuring a safe delay before the two halves are allowed to separate and arm the explosive train.

BRIEF DESCRIPTION OF THE DRAWINGS

Example A

Referring more particularly to the drawings:

FIG. 2 is a cross-sectional view thereof taken along line 2—2 of FIG. 1; and FIG. 2*a* is a cross-sectional view taken along line 2*a*–2*a* of FIG. 2;

FIGS. 3, 4, 5 and 6 are modifications of the timing mechanism.

Example B

Figure 9:
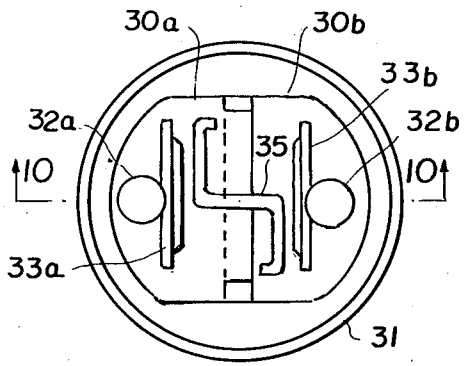
Figure 10:
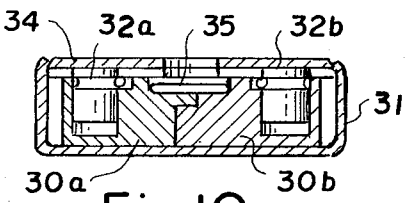
Figure 8:
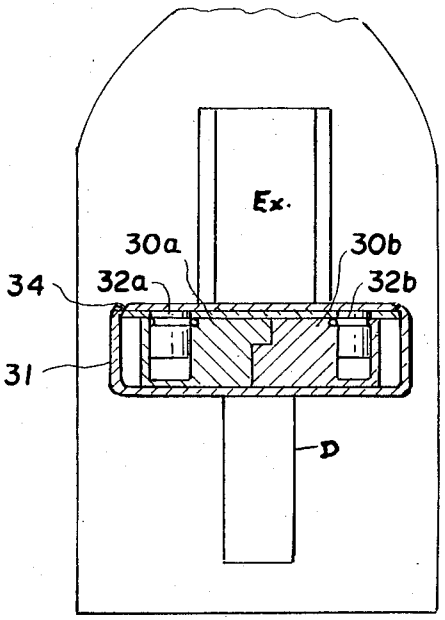

Referring more particularly to the drawings:

FIG. 8 shows a complete assembly of detonator, explosive train, and S & A mechanism for small caliber ammunition;

FIG. 9 is a top view with the cover removed of the S & A mechanism in question; and FIG. 10 is a cross-sectional view of the S & A mechanism taken along line 10—10 of FIG. 9.

DESCRIPTION OF THE PREFERRED EMBODIMENTS

Example A

Figure 1:
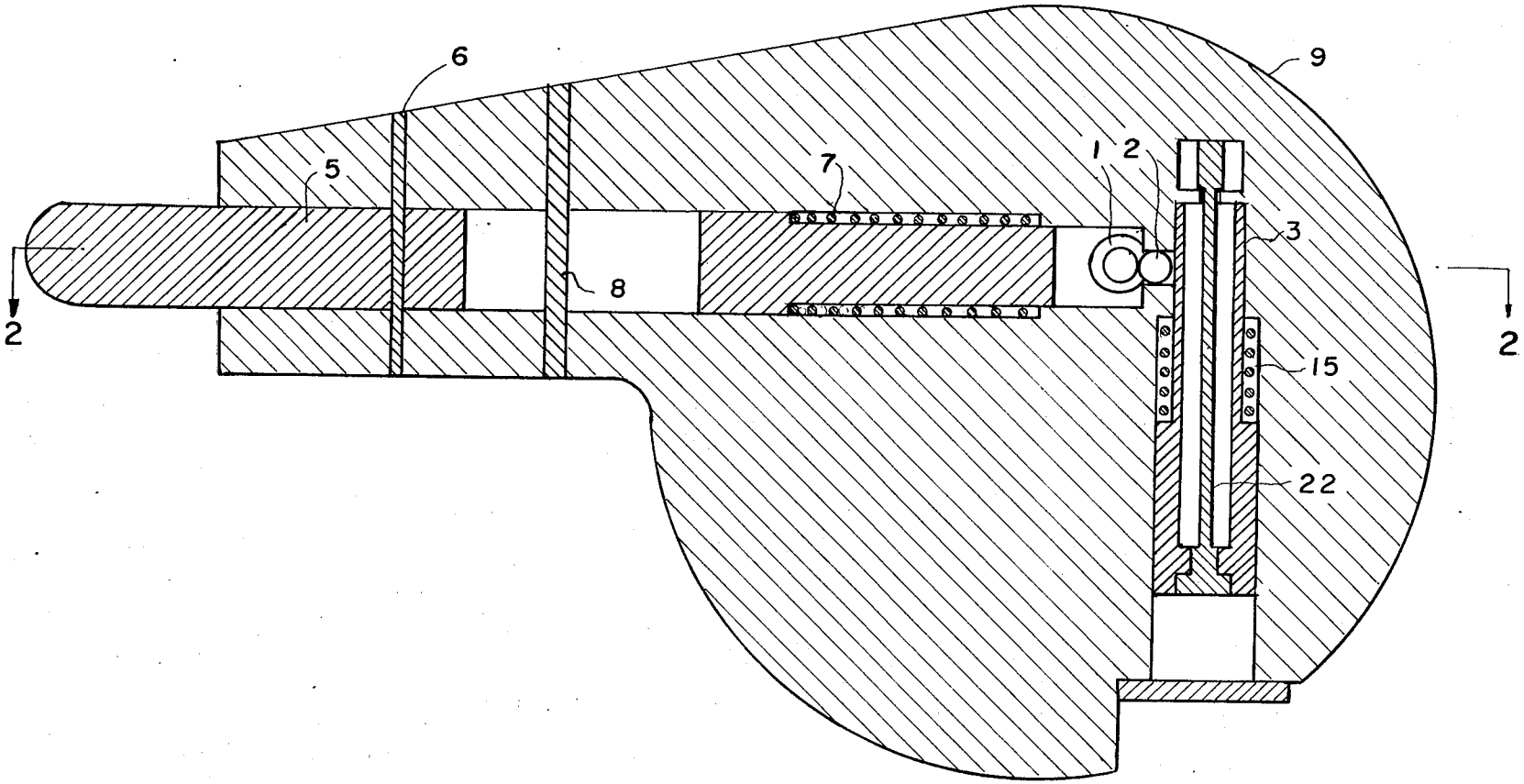
FIG. 1 is a cross-sectional view of the mine fuze timer of the present invention taken along line 1—1 of FIG. 2.
Figure 7:
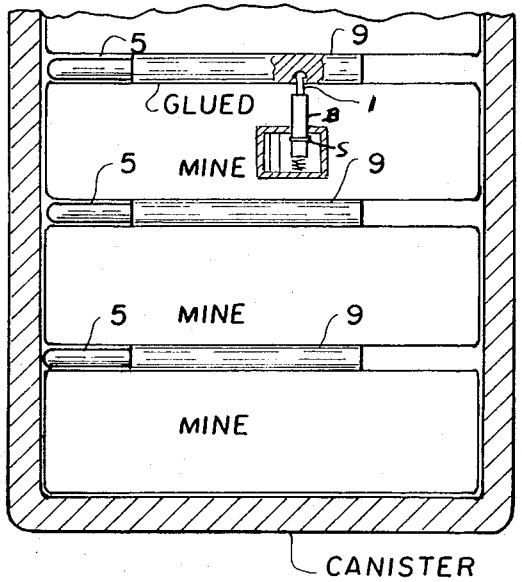
FIG. 7 is a schematic vertical cross-section of entire assembly.

Referring more particularly to FIG. 1 and FIG. 2:

The mine fuze timer is glued on top of the mine (FIG. 7). At that moment, the pin 1 pushes the borerider, which is inside the mine, breaking its locking shear pin. Hence, the borerider spring now pushes the pin 1 which is locked by the locking ball 2 held in safe position by the timing rod 3. The timing rod 3 is locked by a protruding finger 4 of the trigger 5 which is held in safe position by a shear pin 6.

When the mine is loaded into the canister, the trigger 5 is pressed inside the timer body 9 and the shear pin 6 is broken, but the canister holds the trigger 5 in a safe position.

When the mine is ejected from the canister, the trigger 5 moves out, under pressure from the trigger spring 7, and retracts the finger 4, thus freeing the timing rod 3 to start moving against a time measuring mechanism. The retraction of the trigger 5 is limited by the stop pin 8 and remains inside the housing 9. The timing rod 3 will move until there is no more support for the locking ball 2 which is then cammed out by the pin 1 allowing the borerider, inside the mine, to move and the fuze to arm.

Timing rod 3 is hollow and carries a piece of a creeping material of any shape 22 whose end is fixed to the timer housing 9. When the timing rod 3 is released to move, the material 22 is subjected to a tension and slowly stretches until it is broken or the timing rod 3 has reached the end position and has released the locking ball 2. Again, the time needed for this to happen provides the required time delay.

The properties of a creeping material are much less affected by temperature variations than is the viscosity of used liquid. Also, the use of a creeping material offers a potential for a cost reduction in mass production of the mine fuze timer.

FIG. 3 shows a modification wherein the timing mechanism is a liquid dash-pot. The timing rod 3 is made as a hollow piston with at least one O-ring 3*a* to seal off the cavity 10 and force the liquid 11 to flow through a very precisely calibrated orifice 12. The timing rod cavity 13 is sealed by a seal 14 to prevent the liquid 11 from flowing out during the storage. This seal 14 is broken by the pressure in the liquid 11 which is created when the timing rod 3 starts to move.

The timing rod 3 moves under pressure from the timing spring 15. The acting force of the timing spring 15, the shape of the orifice 12, and the viscosity of the liquid 11 are the parameters which determine the required time delay.

FIG. 4 shows an alternate or modification of the timing mechanisms which operates as follows: The tip of the timing rod 3*b* pierces the seal 16 and then pushes the ball 17 forcing the liquid 18 to flow between the ball 17 and the cylinder 19. The spring 20 keeps the ball 17 in the right place during handling and storage.

The tip of the timing rod 3*b* can be blunted as in FIG. 4 or pointed as rods 3*c* and 3*d* in FIGS. 5 and 6, or of any conceivable shape and will cut or shear a wire or a piece of any shape 21 made out of a material which has needed plasticity and will creep when under stress. The time needed to break this piece of such material will provide required time delay. As an example of the material to be used, it can be a readily deformable metal such as lead, tin, etc., or of plastic, or rubber.

Example B

FIGS. 8, 9, and 10 show the construction of a possible S & A mechanism for small caliber ammunition. The barrier consists of two halves 30*a* and 30*b*, which overlap so as to ensure a tight seal between the detonator D and the rest of the explosive train Ex. The base 31 of the housing is shaped so as to present a channel within which the two barrier halves are mounted and can move radially. The two setback pins 32*a* and 32*b* held in safe positions by the spring wires 33*a* and 33*b*, ensure that the two barrier halves are also held in safe positions. The wire 35, made of a soft or stretchable material such as lead, aluminum, tin, or plastic that stretches before rupturing, and mounted within a groove on top of the barrier, also holds the two barrier halves together.

When the ammunition is fired, the high setback causes the two setback pins 32*a* and 32*b* to push their way past the two spring wires 33*a* and 33*b*, thus disengaging from the cover 34 and thereby leaving only the soft wire 35 to hold the two barrier halves 30*a* and 30*b* together. The subsequent high spin with the resultant centrifugal forces pulling the two barrier halves apart, causes the soft wire 35 to stretch and eventually to rupture, thus leading to arming after a safe delay ensured by creep-stretching of the wire 35. Wire 35 may be of other shapes, such as "U"-"Z" so long as the extremities of such shape are locked in place and the intermediate portion is allowed to stretch and then break after a predetermined time.

While I have illustrated and described several embodiments of my invention, it will be understood that these are by way of illustration only and that various changes and modifications may be contemplated in my invention and within the scope of the following claims:

I claim:

1. For use in combination with a canister containing a pluality of mines, each having a borerider therein, each borerider being spring actuated and having a locking shear pin, the improvement comprising a mine fuze timer adhered to the top of each mine, said mine fuze timer having a housing and a trigger slidably mounted in said housing, said trigger having an end portion biased outwardly of said housing against the interior surface of said canister by a spring so as to keep the borerider in safe position, said trigger having a protruding finger opposite said end portion, a timing rod normally locked by said protruding finger, a second spring for effecting movement of said timing rod, and slow acting means for yieldably resisting said movement and so arranged that when each mine is ejected out of said canister, said trigger moves by the action of said first mentioned spring retracting said finger, thus freeing said timing rod to start measuring the appropriate time delay by said slow acting means.

2. Apparatus as recited in claim 1 wherein said slow acting means is a slowly stretchable rod of creeping material.

3. Apparatus recited in claim 1 together with a locking ball seated on the end of said interlocking pin and held in safe position by said timing rod.

4. Apparatus as recited in claim 3 wherein said timing rod has a pointed end, and wherein said slow acting means is a piece of plastic material which is pierced by said pointed end and ultimately broken after a predetermined time period.

5. Apparatus as recited in claim 4 wherein said timing rod has a plurality of pointed ends piercing said piece of plastic material.

6. For use with a mine loaded into a canister, and which mine includes a spring-pressed borerider; the improvement comprising a mine fuze timer adhered to the top of said mine and having an interlocking pin projecting downwardly in contact with said spring-pressed borerider, said mine fuze timer comprising a trigger having a spring under compression at one end of the trigger for normally urging the other end of the trigger in contact with a sidewall of said, locking means at said one end of said trigger for restraining upward movement of said borerider, and timing means for unlocking said locking means after a predetermined time delay.

7. Apparatus as recited in claim 6 wherein said timing means includes a suspended sheet of creeping material, a timing rod having pointed end means engaging said sheet and a spring for yieldably urging said sheet of creeping material after lapse of a predetermined time period necessary to effect such piercing, whereby after said mine is removed from said canister, said mine will not be armed until the lapse of a same time period.

8. Apparatus as recited in claim 6 wherein said spring surrounds said trigger and both are surrounded by a cylindrical housing, and said locking means including a protruding finger at said one end of the trigger, said timing means including a timing rod normally restrained against movement by said finger and upon removal of said mine fuze from said canister permitting said spring to move said timing rod to an unlocked position of said finger.

9. Apparatus as recited in claim 6 wherein said timing means includes a timing rod which terminates with a pointed end, a suspended sheet of soft deformable material, and spring means for continually urging said pointed end against said sheet until it pierces said sheet to provide a safe time delay before arming of said mine fuze.

* * * * *